United States Patent [19]

Helinski

[11] 4,212,420

[45] Jul. 15, 1980

[54] RIBBON STORAGE DEVICE

[75] Inventor: Edward F. Helinski, Johnson City, N.Y.

[73] Assignee: International Business Machines Corp., Armonk, N.Y.

[21] Appl. No.: 49,755

[22] Filed: Jun. 18, 1979

[51] Int. Cl.[2] ..... B65H 17/50

[52] U.S. Cl. ..... 226/118; 242/182

[58] Field of Search ..... 226/118, 119, 97; 242/182, 183, 184, 185

[56] References Cited

U.S. PATENT DOCUMENTS

| | | | |
|---|---|---|---|
| 2,699,089 | 1/1955 | Jakobs | 226/118 X |
| 3,123,269 | 3/1964 | Morley | 226/118 |
| 3,935,980 | 2/1976 | Groat | 226/118 |
| 3,993,233 | 11/1976 | Bartell | 226/118 |

*Primary Examiner*—Edward J. McCarthy

*Attorney, Agent, or Firm*—John S. Gasper

[57] ABSTRACT

A cartridge for an inked ribbon has spring support means which maintains a constant back pressure on a uniformly folded ribbon stack inside the storage compartment of the cartridge. The spring support means is displaceable to adjust for dimensional variations occuring within the stack during use.

10 Claims, 4 Drawing Figures

RIBBON STORAGE DEVICE

CROSS-REFERENCE TO A RELATED APPLICATION

U.S. application of Edward F. Helinski, titled Ribbon Storage Mechanism, Ser. No. 924,462 filed July 14, 1978.

BACKGROUND OF THE INVENTION

This invention relates to ribbon storage devices and particularly to ribbon storage devices of the type commonly called ribbon cartridges or cassettes especially useful for printing machines.

Ribbon cartridges are known in the art where an endless ink ribbon is stacked in uniform folds in a storage chamber by a packing mechanism. The packing mechanism may be external to the ribbon cartridge or may be part of it. The ribbon is drawn from one end of the ribbon stack and fed past recording heads, for example, by the packing mechanism or other means. Such devices are described in U.S. Pat. Nos. 539,683; 764,342; 1,063,289 and 2,685,357, as well as the abovecited related patent application. A known advantage of uniformly-stacked ribbon over randomly stuffed ribbon such as shown in U.S. Pat. Nos. 3,989,132 and 3,974,906 is that storage space is more efficiently used thereby increasing the available supply of storable ribbon. Further advantages of a uniformly folded ribbon are realized in the reduction in hangups and jams within the cartridge which produce wide variations in the tension applied to the ribbon often experienced with randomly stuffed ribbon masses.

In order to provide a uniform ribbon stack, it is necessary for the ribbon to be contained and supported on both ends as well as the outer edges, otherwise the stack can collapse thereby causing bunching or tangling of the ribbon, especially where the ribbon has been used over a long period. The approach shown in the cited patents is to virtually fill the cartridge to the very point of exit. This, however, has been found to cause hangups or jamming at the exit to the cartridge. The problem is aggravated by changes in physical characteristics of the ribbon resulting from its extended use. It has been found that these changes cause the length of the ribbon stack to vary during use, thus the packing mechanism experiences variations in the back pressure which can affect the uniformity of the folding operation. Creasing, curling, uneven wear occuring during extended use, along with and/or the degradation in the uniformity of folding are considered causes for the variation in the length of the ribbon stack and the variation in the back pressure.

SUMMARY OF THE INVENTION

It is a general object of this invention to provide an improved ribbon cartridge.

It is a specific object of this invention to provide an improved ribbon cartridge useful for a printer apparatus.

It is a more specific object of the invention to provide an improved ribbon cartridge in which the ribbon is continuous.

It is a further object to provide an improved ribbon cartridge which avoids the problems associated with changes in the physical characteristics associated with the extended use of the ribbon.

It is a further specific object of this invention to provide an improved ribbon cartridge which overcomes problems caused by changes in the dimensions of a uniformly folded ribbon stack due to changes in the physical characteristics of the ribbon produced by use of the ribbon.

It is an additional object of this invention to provide an improved ribbon cartridge of one or more of the above types in which the ribbon cartridge may be separable from a ribbon packing mechanism without the ribbon falling from an open-ended part of the cartridge.

The above, as well as other objects are attained in accordance with this invention by providing a ribbon cartridge storage device in which stack support means is provided within a ribbon storage receptacle which automatically compensates for dimensional changes in the ribbon stack. In the preferred embodiment of the invention, the adjustable stack support means comprises spring means located within the receptacle some distance from the exit to provide a slack zone in which an unfolded length of ribbon extends from the folded stack to the exit of the receptacle. As the stack dimensions change, the spring means is displaced allowing the stack to adjust its length based on the variation in the pressure produced in the stack by the packing mechanism.

The springs are preferably roll springs commonly called negator springs which may be attached to a wall of the receptacle in a manner which allows the spring to unroll in response to variations in pressures built up in the ribbon stack. In the preferred embodiment, a pair of negator springs are attached to opposite sidewalls to apply pressure to opposite edges of the removal end of the ribbon stack. The negator springs are individually movable along the receptacle so that as the ribbon folds are withdrawn from the stack by the withdrawal tension, each spring can unroll a limited amount to release the ribbon fold while the other spring continues to maintain a substantially constant pressure at the entrance of the stack. A feature of the invention further comprises a guide means such as recesses or wells formed in theavoid encroachment into the slack zone and interference with the operation of the other negator spring. A further feature of the invention is the provision of ribbon retention means in the receptacle for holding the ribbon stack near the open-end of the cartridge to prevent the ribbon from falling from the storage compartment when separated from the packing mechanism as a result of the pressure applied by the negator springs. In the preferred form the ribbon retention means comprises bent springs attached to the receptacle walls and are contoured to be deflected by the packing mechanism when the cartridge is assembled to the packing mechanism which is mounted on a machine such as a printer apparatus. The packing mechanism is provided with grooves which receive the ribbon retention springs to locate and retain the cartridge in a fixed position during the packing and feeding operations.

With these arrangements the dimensional changes of the ribbon stack is compensated for by the unrolling or displacement of the negator springs. Also, the springs allow the ribbon to be pulled from the stack without increasing the tension on the ribbon as it is being withdrawn from the cartridge. Furthermore, the negator springs continuously maintain a near constant reverse pressure at the stack entrance which operates to improve the uniformity of the folding of the ribbon by the print mechanism.

DETAILED DESCRIPTION

Figure 3:
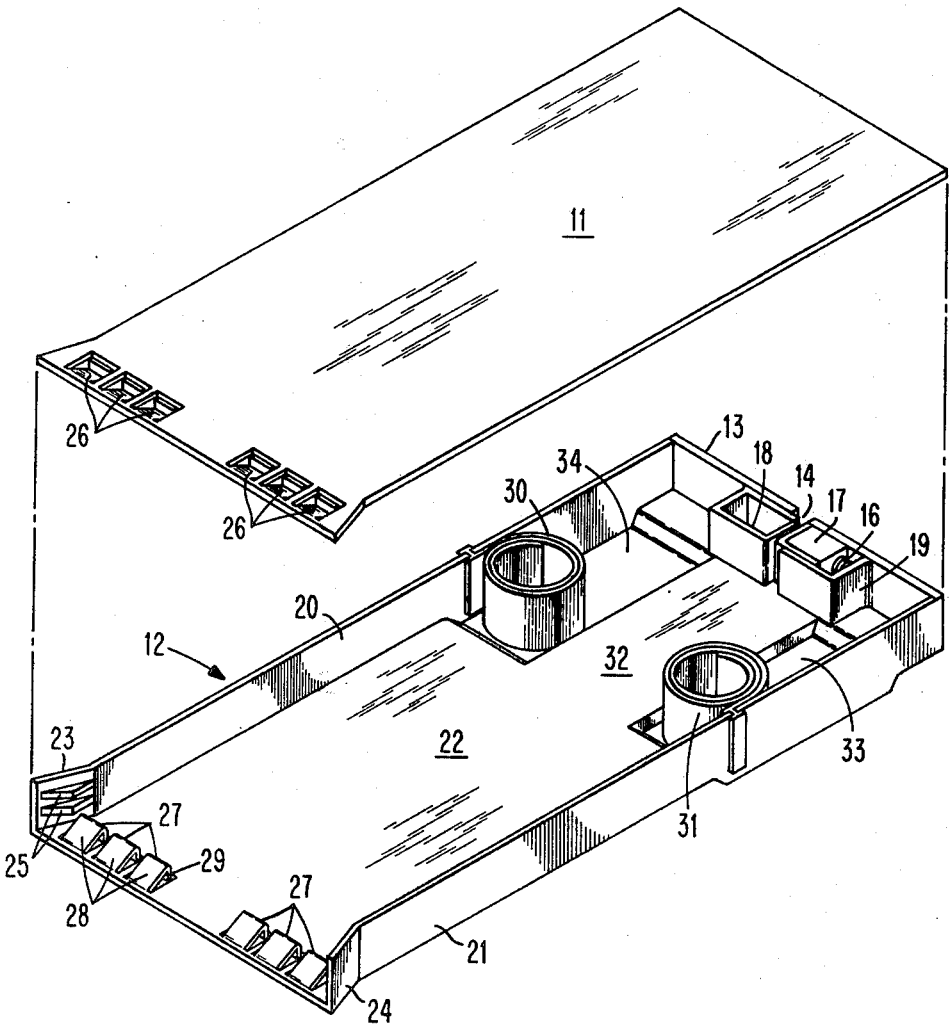
FIG. 3 is an exploded three-dimensional view of the receptacle portion of FIG. 1 inverted to more clearly show its interior construction.

Referring to the drawings and particularly to FIG. 3, the ribbon storage device which incorporates the present invention is a cartridge 10 (See FIG. 1) comprising a flat cover plate 11 and a box member 12 which when assembled form a rectangular receptacle having a storage compartment for a uniformly folded ribbon stack. Box member 12 has an end wall 13 with an exit slit 14 whereby ribbon 15 (see FIG. 1) is withdrawn from the storage compartment of cartridge 10. Frictional drag is applied to the ribbon by bias spring 16 acting on a plunger 17 which presses the ribbon against a fixed block 18 in side box member 12 immediately adjacent exit slit 14. Guide walls 19 for the plunger 17 and the fixed block 18 are formed as integral parts with the end wall 13. Box member 12 further comprises parallel side walls 20 and 21 which extend vertically from a flat base plate 22. Cartridge 10 is open-ended for attachment to a stuffer mechanism to be described later which is part of the machine apparatus. For this purpose side walls 20 and 21 of box member 12 have flanges 23 and 24. Horizontal ribs 25 on the interior wall sections of flanges 23 and 24 serve to locate the cartridge vertically relative to the feed rolls of the packing mechanism. Leaf springs 26 and 27 in cover plate 11 and base plate 22 respectively of box member 12 provide the retention means for the ribbon stack whereby the ribbon stack is prevented from falling from the opened end of cartridge 10 when the cartridge is disassembled from the packer mechanism. Leaf springs 26 and 27 are bent to have a forward camming surface 28 and a stack retaining surface 29 which engages the ribbon stack.

Figure 1:
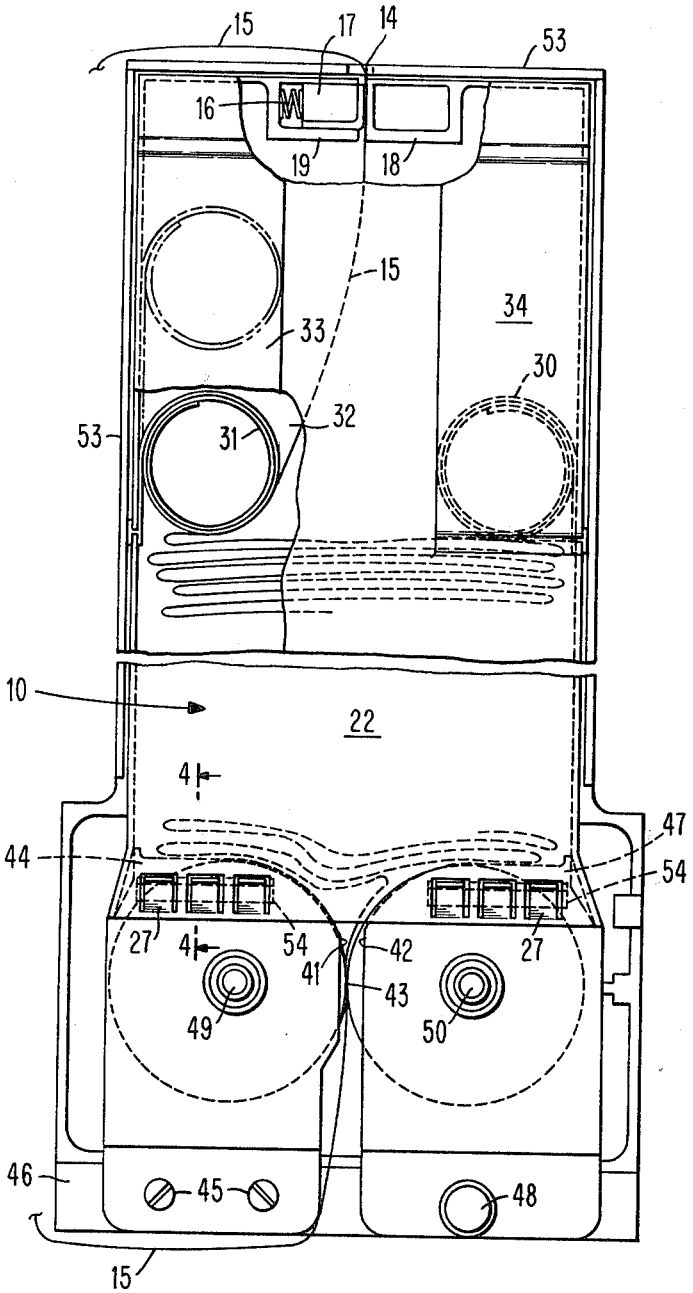
FIG. 1 is a top view showing a ribbon cartridge and packing mechanism with parts cut away to reveal details of the internal structure pertinent to the invention.

In accordance with this invention, a ribbon stack support is provided which automatically compensates for changes in the space occupied by the multiple folded ribbon stack. In the embodiment shown in FIGS. 1–3, the ribbon stack support means comprises a pair of flat roll springs 30 and 31 commonly known as negator springs. The outer end of spring 30 is attached to side wall 20 while spring 31 is similarly attached to wall 21. Springs 30 and 31 are located ahead of the frictional drag mechanism at the mouth of exit slit 14 so that a slack zone 32 is provided between the ribbon stack and the exit slit 14. Referring specifically to FIG. 1, as ribbon 15 is drawn through exit slit 14, the ribbon becomes taut in the slack zone 32 until the ribbon is pulled from the stack against the pressure of the negator springs 30 and 31. As each half fold of ribbon 15 comes loose, a slack portion of the ribbon resides in the slack zone 32 until the slack is used up and the other half fold is pulled from the other negator spring. During this drawing action the friction between the negator springs 30 and 31 may cause them independently to unroll slightly in the direction of ribbon tension. Upon release of ribbon 15 from pressure contact with the negator springs each negator spring independently rolls back and re-engages the following fold of the ribbon stack. The process is repeated alternately on opposite sides of the withdrawal end of the ribbon stack. As previously discussed the ribbon stack is subject to variations in its length due to changes in the characteristics of the ribbon. When such changes occur the pressure built up by the ribbon stack causes the negator springs to unroll i.e. displace the negator springs to a position more or less remote from the opening end of the cartridge where the packing mechanism is folding the ribbon. A characteristic of the negator springs 30 and 31 which is of a special value in the practice of this invention is the fact that the back pressure imposed by them on the stack is substantially constant.

As the negator springs 30 and 31 are unrolled by tension of the ribbon or the displacement caused by the expansion of the ribbon stack it is desirable that the negator springs act independently of each other and do not encroach upon the slack zone 32 for the unfolded ribbon. For that purpose, guide means in the form of wells 33 and 34 are provided in the base plate 22 of box member 12. The wells 33 and 34 and the negator springs 30 and 31 are designed to restrict the movement of the negator springs along a straight path.

Figure 2:
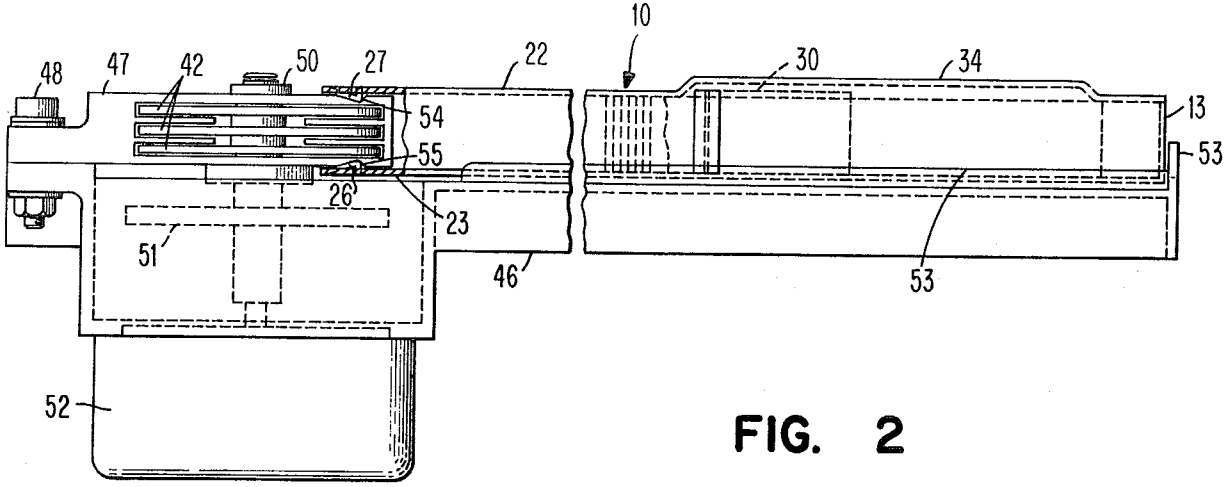
FIG. 2 is a partial section of the apparatus of FIG. 1 as viewed from the right side.
Figure 4:
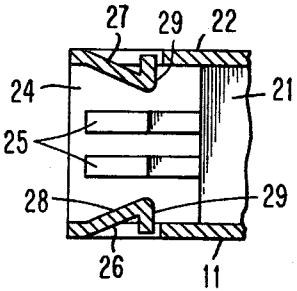
FIG. 4 is a detail in section showing the ribbon retention structure of the receptacle of FIG. 1.

In the preferred embodiment of this invention the packing mechanism and cartridge 10 are separable. As seen in FIGS. 1, 2 and 4 a packing mechanism comprises a pair of feed rolls 41 and 42 rotatable in contact form a nip at 43 to grip a flat ribbon 15. The feed roll 41 is mounted in bearings and is assembled along with the stripping device 44 which is attached via bolts 45 to a frame member 46. Feed roll 42 is assembled with stripping device 47 which is pivotally attached by pin 48 to frame 46. Further details of structure and operation of the drive rolls 41 and 42 with the stripping devices and attachment to the frame may be more clearly understood by referral to the related co-pending application. Drive shafts 49 and 50 for the feed rolls are connected through drive gearing 51 (See FIG. 2) to an electric motor 52 which could be a stepping motor. In the apparatus of FIGS. 1 and 2 the cartridge 10 is placed within a recess defined by a ledge 53 which extends upwardly from frame 46. When cartridge 10 is located in the recess, feed rolls 41 and 42 and the stripper devices 44 and 47 extend partially into the open end of cartridge 10. In that condition the ribbon retainer springs 26 and 27 on the cover plate 11 and the base plate 22 of cartridge 10 have been cammed outwardly by the engagement of the stripper mechanism with the camming surfaces 28 of retainer springs 26 and 27. Slots 54 and 55 on the upper and lower surfaces respectively of the stripper mechanisms provide recesses for the retainer springs 26 and 27 to hold the cartridge 10 firmly in place during the ribbon feeding operation. Recesses 54 and 55 are preferably slanted toward the storage compartment area of the cartridge so that the vertical retaining surfaces 29 of retaining springs 26 and 27 are cammed outwardly when the cartridge is removed from the packing mechanism.

Thus, as the cartridge 10 is separated from the packing mechanism, the retainer springs 26 and 27 are initially deflected outwardly to release the cartridge from the packing mechanism. As soon as the cartridge is completely removed from engagement with the packing mechanism, the retainer springs 26 and 27 snap inwardly so that retaining surfaces 29 come into place to engage the open-ended folds of the ribbon stack.

Thus, it is now possible to carry the cartridge 10 fully loaded with a compressed ribbon stack under pressure from the negator springs 30 and 31 without concern for the ribbon being ejected from the cartridge.

While the invention has been described in connection with a cartridge which is separable from the packing mechanism, all or part of the packing mechanism could be included as part of the total assembly. Likewise, while the invention is described primarily in its form that would be utilized in a printer apparatus, the invention could be practiced in other ribbon storage devices for use in other applications. In any event, the advantages of substantially constant pressure, adjustments and the dimensions of the stack, simplicity of design and ease of manufacture are apparent in the detail description.

While the invention has been particularly shown and described with reference to a preferred embodiment thereof, it will be understood by those skilled in the art that the foregoing and other changes in form and details may be made therein without departing from the spirit and scope of the invention.

Having thus described my invention, what I claim as new, and desire to secure by Letters Patent is:

1. A ribbon storage device comprising:

a receptacle having a compartment for storing a stack of uniformly folded ribbon, said receptacle having an exit for withdrawing ribbon in a single strand from said stack, support means within said receptacle for engaging said ribbon stack at the end thereof closest to said exit, said support means having the characteristic of automatically compensating for variations in the space occupied in the storage compartment by said ribbon stack due to expansion or contraction thereof.

2. A ribbon storage device in accordance with claim 1 in which said stack support means has the further characteristic of maintaining a substantially constant back pressure at the withdrawal end of said ribbon stack.

3. A ribbon storage device in accordance with claim 1 in which said stack support means comprises resilient support means attached to said receptacle so as to engage said stack within said compartment near said withdrawal end as the ribbon is drawn from said receptacle.

4. A ribbon storage device in accordance with claim 3 in which said resilient support means comprises spring members deflectable toward said exit of said receptacle in response to withdrawal forces applied to said ribbon and said expansion and contraction pressures produced within said ribbon stack.

5. A ribbon storage device in accordance with claim 4 in which said spring means comprises a pair of spring members attached to opposite walls of said receptacle in spaced apart relation to form a slack zone for said ribbon between said withdrawal end of said stack and said exit slit.

6. A ribbon storage device in accordance with claim 5 in which said spring members are negator spring elements having one end thereof attached to said opposite walls of said receptacle whereby said spring elements can roll under pressure variations applied thereto by said ribbon stack.

7. A ribbon storage device in accordance with claim 6 in which said receptacle includes guide means for said negator springs, said guide means acting to control the rolling motion of said negator springs by the withdrawal and engagement with said ribbon stack to a predetermined region along said slack zone in said receptacle.

8. A ribbon storage device in accordance with claim 7 in which said guide means comprises recesses formed within the side of said receptacle adjacent said opposite walls thereof, said recesses forming space for said negator springs to unroll along and adjacent to said slack zone.

9. A ribbon storage device in accordance with claim 3 in which said receptacle has an open end to receive a ribbon folding mechanism within the compartment portion of said receptacle, said receptacle being manually separable from said ribbon folding mechanism, ribbon retention means on said receptacle in the vicinity of said open end thereof, said ribbon retention means being deflectable upon entry of said folding mechanism into said open end of said receptacle and operable to engage said folding mechanism to hold said receptacle in engagement with said folding mechanism, and said ribbon retention means being operable to engage the stack in the vicinity of said open end upon separation of said receptacle from said folding mechanism whereby said ribbon stack is prevented from being ejected by operation of said resilient stack support means in the vicinity of said exit end of said receptacle.

10. A ribbon storage device in accordance with claim 9 in which said ribbon retention means comprise spring elements attached to wall portions of said receptacle, said spring elements being bent to extend inwardly to close the open end of said receptacle, said spring means having a camming surface for engagement with and deflection by said folding mechanism upon entry of said folding mechanism into said receptacle.

* * * * *

UNITED STATES PATENT AND TRADEMARK OFFICE

CERTIFICATE OF CORRECTION

PATENT NO. : 4,212,420

DATED : July 15, 1980

INVENTOR(S) : E. F. Helinski

It is certified that error appears in the above-identified patent and that said Letters Patent are hereby corrected as shown below:

Column 2, Line 41:

After "the" and before "avoid" add --receptacle which restrain the negator springs to cause unwinding along a fixed straight path to--

Signed and Sealed this

*Eleventh* Day of *November 1980*

[SEAL]

*Attest:*

SIDNEY A. DIAMOND

*Attesting Officer*

*Commissioner of Patents and Trademarks*